US009199494B2

(12) United States Patent
Sasaki

(10) Patent No.: US 9,199,494 B2
(45) **Date of Patent: *Dec. 1, 2015**

(54) RECORDING APPARATUS

(71) Applicant: SEIKO EPSON CORPORATION, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/669,038

(22) Filed: Mar. 26, 2015

(65) Prior Publication Data

US 2015/0197108 A1 Jul. 16, 2015

Related U.S. Application Data

(63) Continuation of application No. 14/330,387, filed on Jul. 14, 2014, now Pat. No. 9,022,547, which is a continuation of application No. 14/074,970, filed on Nov. 8, 2013, now Pat. No. 8,807,741, which is a continuation of application No. 13/324,733, filed on Dec. 13, 2011, now Pat. No. 8,616,696.

(30) Foreign Application Priority Data

Dec. 24, 2010 (JP) ..... 2010-288115

(51) Int. Cl.

| | |
|---|---|
| ***B41J 2/01*** | (2006.01) |
| ***B41J 13/00*** | (2006.01) |
| ***B41J 11/00*** | (2006.01) |

(52) U.S. Cl.

CPC ..... *B41J 13/0009* (2013.01); *B41J 11/0035* (2013.01)

(58) Field of Classification Search

CPC .... B41J 11/002; B41J 11/0035; B41J 11/007; B41J 13/103; B41J 11/0005; B41J 15/04

USPC ..... 347/16, 17, 101, 102, 104

See application file for complete search history.

(56) References Cited

U.S. PATENT DOCUMENTS

| | | | |
|---|---|---|---|
| 8,162,470 | B2 | 4/2012 | Kanai et al. |
| 8,616,696 | B2 | 12/2013 | Sasaki |
| 8,807,741 | B2 | 8/2014 | Sasaki |
| 2003/0151652 | A1 | 8/2003 | Shima et al. |
| 2003/0156177 | A1 | 8/2003 | Nishikawa et al. |
| 2005/0151815 | A1 | 7/2005 | Kanai et al. |

FOREIGN PATENT DOCUMENTS

| | | |
|---|---|---|
| CN | 1438123 | 8/2003 |
| EP | 07/27/2005 | 7/2005 |
| JP | 05-286130 | 11/1993 |
| JP | 2006-224460 | 8/2006 |
| JP | 4429923 | 12/2009 |
| JP | 2010-094919 | 4/2010 |

*Primary Examiner* — An Do

(74) *Attorney, Agent, or Firm* — Workman Nydegger

(57) ABSTRACT

A recording apparatus includes a recording head that ejects liquid onto a recording medium, a transporting device that transports the recording medium along a supporting surface of a supporting member, and a preheating device that preheats the recording medium to the upstream side of the recording head in a transporting direction of the recording medium. The preheating device includes a preheating unit that increases the amount of heat per unit time which is applied to the recording medium as the recording medium is moved toward the downstream side in the transporting direction. The supporting member includes the supporting surface and bending portions.

3 Claims, 5 Drawing Sheets

RECORDING APPARATUS

This application is a Continuation of U.S. patent application Ser. No. 14/330,387, filed Jul. 14, 2014, and issued as U.S. Pat. No. 9,022,547 on May 5, 2015, which is a Continuation of U.S. patent application Ser. No. 14/074,970, filed Nov. 8, 2013 and issued as U.S. Pat. No. 8,807,741 on Aug. 19, 2014, which is a Continuation of U.S. patent application Ser. No. 13/324,733, filed Dec. 13, 2011 and issued as U.S. Pat. No. 8,616,696 on Dec. 31, 2013, which claims priority to Japanese Patent Application No. 2010-288115, filed Dec. 24, 2010, which applications are expressly incorporated by reference herein.

BACKGROUND

1. Technical Field

The present invention relates to a recording apparatus.

2. Related Art

An ink jet printer is known as a type of recording apparatus that records images or characters by ejecting fluid onto a recording medium. In the ink jet printer, when ink (fluid) that needs permeation drying or evaporation drying is used, there is need for a heating device to be provided to dry the ink ejected on the recording medium.

Japanese Patent No. 4429923 and JP-A-5-286130 disclose apparatuses that are equipped with a preheating device that preheats a recording medium at the upstream side of an ink jet head on a transporting path of the recording medium and can prevent agglomeration and permeation of landed ink and perform high quality printing by heating the recording medium at a predetermined temperature or higher before ejecting the ink.

However, when the temperature of the recording medium is rapidly increased by the preheating, printing defects may be caused by wrinkles due to thermal extension of the recording medium.

SUMMARY

An advantage of some aspects of the invention is to provide a recording medium that can prevent a recording medium from being wrinkled by preheating and perform high quality printing.

A recording apparatus according to an aspect of the invention includes: a recording head that ejects liquid onto a recording medium; a transporting device that transports the recording medium along a supporting surface; and a preheating device that preheats the recording medium to the upstream side of the recording head in the transporting direction of the recording medium, in which the preheating device includes a preheating unit that increases the amount of heat per unit time which is applied to the recording medium, as the recording medium is moved toward the downstream side in the transporting direction.

According to this configuration, as the recording medium is transported toward the recording head to the downstream side in the transporting direction, the recording medium is preheated while gradually receiving a larger amount of heat, such that the temperature is not increased rapidly. Therefore, it is possible to prevent wrinkles due to thermal extension of the recording medium.

Further, the heating section may be a configuration including a plurality of heating sources arranged along the supporting surface, with gaps decreasing toward the downstream side in the transporting direction.

According this configuration, since the gaps of the heating sources arranged along the supporting surface decrease toward the downstream side in the transporting direction, it is possible to increase the amount of heat per unit time that is applied to the recording medium, toward the downstream side in the transporting direction.

The heating section may include: a supporting member that has the supporting surface and a plurality of bending portions that bend along a virtual curved line having the center of curvature at the opposite side to where the supporting surface is provided such that the gaps decrease toward the downstream side in the transporting direction; and an indirect-heating device that heats the recording medium on the supporting surface by heating the supporting member.

According to this configuration, since the gaps between the bending portions decrease toward the downstream side in the transporting direction, the area which comes in contact with the bending portions (supporting surface) heated as the recording medium is moved toward the downstream side in the transporting direction, increases, and as result, it is possible to increase the amount of heat per unit time which is applied to the recording medium, toward the downstream side in the transporting direction.

Further, in the apparatus, the heating section may have a configuration including a temperature control unit that increases the temperature of the heating sources arranged along the supporting surface, toward the downstream side in the transporting direction.

According this configuration, since the temperature of the heating sources arranged along the supporting surface increases toward the downstream side in the transporting direction, it is possible to increase the amount of heat per unit time that is applied to the recording medium, toward the downstream side in the transporting direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
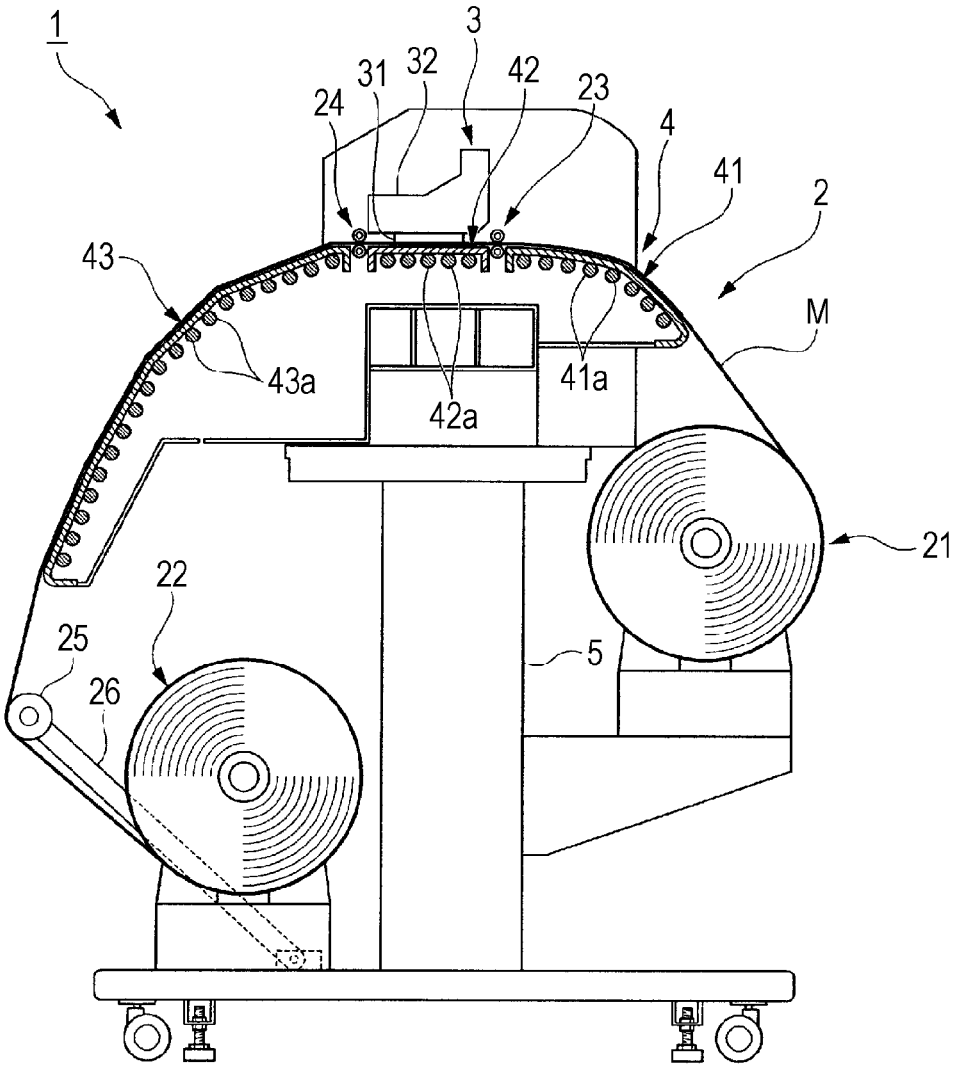
FIG. 1 is a view showing the configuration of a printer according to a first embodiment of the invention.

Embodiments of a recording apparatus of the invention are described with reference to the drawings. Further, the scales of the members are appropriately changed such that the members can be recognized in the drawings used for the following description. An ink jet type printer (hereafter, simply referred to as a printer) is exemplified in the embodiment as a recording apparatus of the invention.

First Embodiment

FIG. 1 is a view showing the configuration of a printer 1 according to a first embodiment of the invention.

The printer 1 is a large format printer (LFP) handling relatively large media (recording media) M. The medium M of the embodiment is implemented by a vinyl chloride series having a width of, for example, 64 inches.

As shown in FIG. 1, the printer 1 includes a transporting unit (transporting device) 2 that transports the medium M in a roll-to-roll method, a recording unit 3 that records images or characters by ejecting ink (fluid) onto the medium M, and a heating unit (heating device) 4 that heats the medium M. The units are supported by a main body frame 5.

The transporting unit 2 includes a roll 21 that discharges a rolled medium M and a roll 22 that winds the discharged medium M. The transporting unit 2 includes a pair of transporting rollers 23 and 24 that transport the medium M on a transporting path between the rolls 21 and 22. Further, the transporting unit 2 includes a tension roller (tensing device) 25 that applies tension to the medium M on the transporting path between the paired transporting roller 24 and the roll 22.

The tension roller 25 is supported by an oscillation frame 26, in contact with the rear side of the medium M in the width direction (perpendicular to the page in FIG. 1). The tension roller 25 is formed longer in the width direction than the width of the medium M. The tension roller 25 is disposed further to the downstream side in the transporting direction than the after-heater unit 43 of the heating unit 4, which is described below.

The recording unit 3 includes an ink jet head (recording head) 31 that ejecting ink (fluid) onto the medium M on the transporting path between the pair of transporting rollers 23 and 24 and a carriage 32 that is equipped with the ink jet head 31 and freely reciprocates in the width direction. The ink jet head 31 has a plurality of nozzles and can eject ink that needs permeation drying or evaporation drying, which was selected based on the relationship with the medium M.

The heating unit 4 heats the medium M, thus preventing bleeding and blurring and improves the image quality by rapidly drying and fixing the ink on the medium M. The heating unit 4 has a supporting surface that is a portion of the transporting path of the medium M, and heats the medium M on the supporting surface while bending and supporting the medium M protruding upward between the rolls 21 and 22.

The heating unit 4 includes a preheater unit 41 that preheats the medium M further to the upstream side in the transporting direction from the position where the recording unit 3 is disposed, a platen heater unit 42 that heats the medium M, opposite to the recording unit 3, and an after-heater unit 43 that heats the medium M further to the downstream side in the transporting direction from the position where the recording unit 3 is disposed.

In the embodiment, heating temperature of the heater 41*a* in the preheater unit 41 is set at 40° C. Further, in the embodiment, heating temperature of a heater 42*a* in the platen heater unit 42 is set at 40° C. (the desired treatment), the same as in the heater 41*a*. Further, in the embodiment, heating temperature of a heater 43*a* in the after-heater unit 43 is set at 50° C., higher than that of the heaters 41*a* and 42*a*.

The preheater unit 41 rapidly dries the ink from when the ink lands by gradually increasing the temperature of the medium M to a desired temperature (the temperature of the platen heater unit 42) from room temperature. Further, the platen heater unit 42 allows the ink to land on the medium M with the desired temperature maintained, and encourages the ink to dry rapidly from when the ink lands.

Further, the after-heater unit 43 rapidly dries the remaining ink that lands on the medium M and not dried yet by increasing the temperature of the medium M higher than the desired temperature, and completely dries and fixes the landed ink onto the medium M at least before the medium is wound on the roll 22.

Next, a characteristic configuration of the preheater unit 41 according to the embodiment is described with reference to FIGS. 2 and 3.

Figure 2:
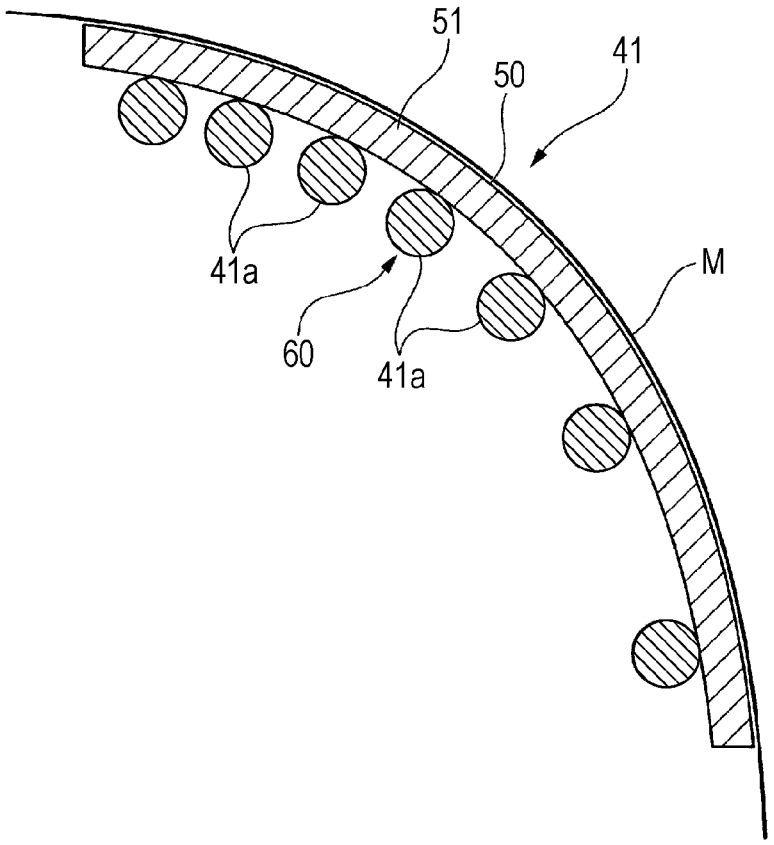
FIG. 2 is a cross-sectional view showing the configuration of a preheater unit according to the first embodiment of the invention.
Figure 3:
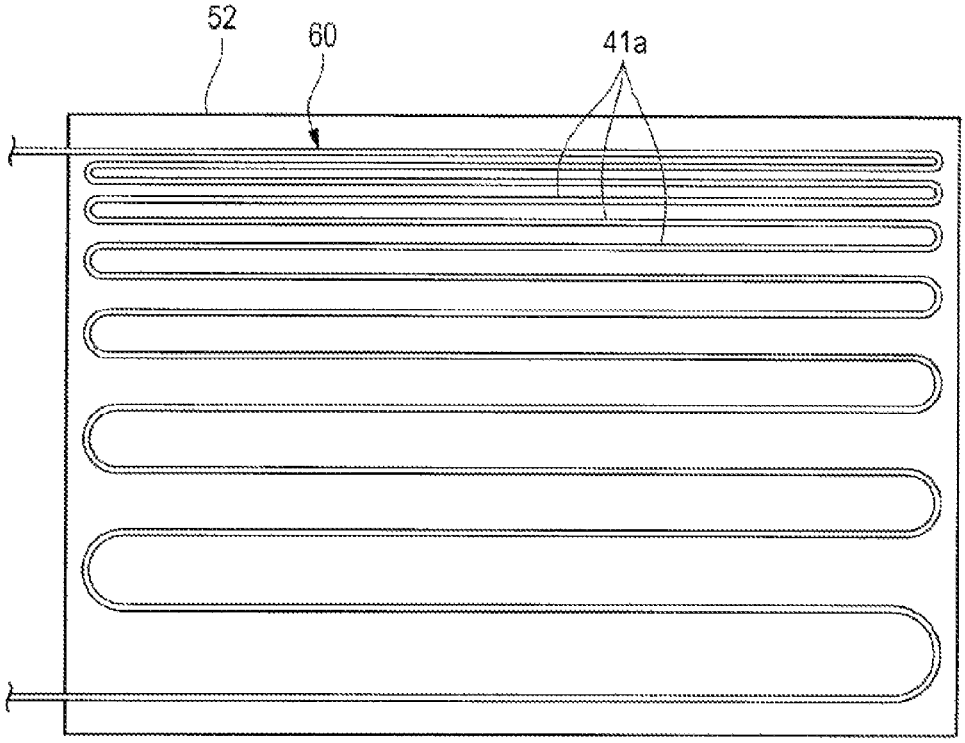
FIG. 3 is a plan view showing the configuration of heaters according to the first embodiment of the invention.

FIG. 2 is a cross-sectional view showing the configuration of the preheater unit 41 according to the first embodiment of the invention. FIG. 3 is a plan view showing the configuration of the heater 41*a* according to the first embodiment of the invention.

As shown in FIG. 2, the preheater unit 41 has a supporting member 51 having a supporting surface 50 supporting the medium M. The supporting member 51 according to the embodiment is formed of a steel sheet, and more specifically, SPCC (cold-rolled steel plate). The supporting member 51 is formed longer in the width direction than the width of the medium M, and more specifically, longer than a width of about 64 inches.

The preheater unit 41 includes a heating section 60 that increases the amount of heat per unit time which is applied to the medium M, as the medium M moves to the downstream side in the transporting direction. The heating section 60 according to the embodiment includes a plurality of heaters (heating sources) 41*a* disposed along the supporting surface 50, with gaps decreasing toward the downstream side in the transporting direction.

The heating section 60 is disposed on the back of the supporting surface 50 of the supporting member 51. As shown in FIG. 3, the heating section 60 according to the embodiment is a tube heater and is bonded to the back of the supporting member 51 by an aluminum tape 52. Accordingly, in the embodiment, the heaters 41*a* heat the medium M supported on the supporting surface 50 from the back by transferring heat through the supporting member 51.

The heater 41*a* according to the embodiment is the portion extending in the width direction (left-right direction of the paper in FIG. 3) of the tube heater with wrinkles. The heaters 41*a* are disposed with gaps in the transporting direction (the up-down direction of the paper in FIG. 3). The heaters 41*a* according to the invention are disposed with the gaps decreasing toward the downstream side (the upper portion of the paper in FIG. 3) in the transporting direction. In detail, the heaters 41*a* are disposed such that the gap between the heaters 41*a* close to the downstream side in the transporting direction is smaller than the gap between the heaters 41*a* close to the upstream side (lower portion of the paper in FIG. 3) in the transporting direction.

The preheater unit 41 is gradually warmed to a desired temperature by the heating section 60 until the medium M reaches the recording unit 3. In the embodiment, the temperature (desired preheating temperature) when the medium M reaches the lowermost portion of the preheater unit 41 is set within ±5° C. of the temperature (desired temperature: 40° C.) of the platen heater unit 42. Further, the rising temperature range when the medium M passes the platen heater unit 42 is set at 30% or less of the desired preheating temperature. Further, the setting of the preheater unit 41 is set in consideration of the transporting speed (60 $m^2$/hr in the embodiment) by the transporting unit 2.

Next, the operation of preheating of the preheater unit 41 and prevention of the wrinkles on the medium M is described.

In the recording unit 3 shown in FIG. 1, the medium M is transported by the transporting unit 2, when recording (printing) on the medium M is started. The preheater unit 41 supports the media M sequentially sent out from the roll 21 with the supporting surface 50 and increases the temperature of the medium M from the room temperature up to the desired preheating temperature until the medium M reaches the recording unit 3.

As shown in FIG. 2, the heater 41*a* is disposed on the back of the supporting member 51 having the supporting surface 50. The heater 41*a* heats the medium M supported on the supporting surface 50 from the back by transferring heat through the supporting member 51. Accordingly, since the medium M is heated from the back, it is possible to reduce or prevent thermal damage to the front (print surface) of the medium M before the medium reaches the recording unit 3.

Further, the heaters 41*a* disposed along the supporting surface 50 are arranged with the gaps decreasing toward the downstream side in the transporting direction. Therefore, in the preheater unit 41, it is possible to increase the amount of heat per unit time which is applied to the medium M, as the medium M moves to the downstream side in the transporting direction.

That is, since the arrangement of the heaters 41*a* becomes dense toward the downstream side in the transporting direction, the supporting surface 50 at the downstream side in the transporting direction with dense arrangement is larger in temperature than the supporting surface 50 at the upstream side in the transporting direction with sparse arrangement, even though the amount of heat per unit time applied by the heaters 41*a* is uniform. Therefore, a temperature inclination that gradually increases is generated toward the downstream side in the transporting direction, in the supporting surface 50, such that the medium M can be gradually warmed until reaching the recording unit 3.

Accordingly, as the medium M is transported toward the recording unit 3 to the downstream side in the transporting direction, it is preheated while gradually receiving a larger amount of heat, such that it is possible to increase the temperature up to the desired preheating temperature and prevent the medium M from rapidly increasing in temperature. That is, since the temperature of the most upstream side of the supporting surface 50 is the lowest and close to the room temperature that is the temperature of the media M sequentially sent out from the roll 21, in the preheater unit 41, the temperature of the medium M does not rapidly increase and thermal extension of the medium M proceeds relatively smoothly without a thermal problem, such that wrinkling or bending is prevented. Therefore, high quality printing can be performed by the recording unit 3.

Therefore, according to the embodiment described above, in the printer 1 including the ink jet head 31 ejecting ink onto the medium M, the transporting unit 2 transporting the medium M along the supporting surface 50, and the preheater unit 41 preheating the medium M to the upstream side of the ink jet head 31 in the transporting direction of the medium M, the preheater unit 41 employs the configuration including the heating section 60 that increases the amount of heat per unit time applied to the medium M, as the medium M is moved to the downstream side in the transporting direction, such that the medium M is gradually warmed while receiving a larger amount of heat, as the medium M is transported toward the ink jet head 31 to the downstream side in the transporting direction, thereby preventing a rapid increase in temperature. Therefore, it is possible to prevent wrinkles due to thermal extension of the medium M.

Therefore, it is possible to achieve the printer 1 that can perform high quality printing by preventing the medium M from being wrinkled by preheating in the embodiment. Further, since the heating section 60 is implemented by densely arranging the heaters 41*a*, it is unnecessary to separately provide a device for controlling temperature and it is possible to contribute to cost reductions, in the embodiment.

Second Embodiment

Next, the second embodiment of the invention is described. In the following description, the same or equivalent components as those in the embodiment described above are given the same reference numerals and they are briefly or not described.

Figure 4:
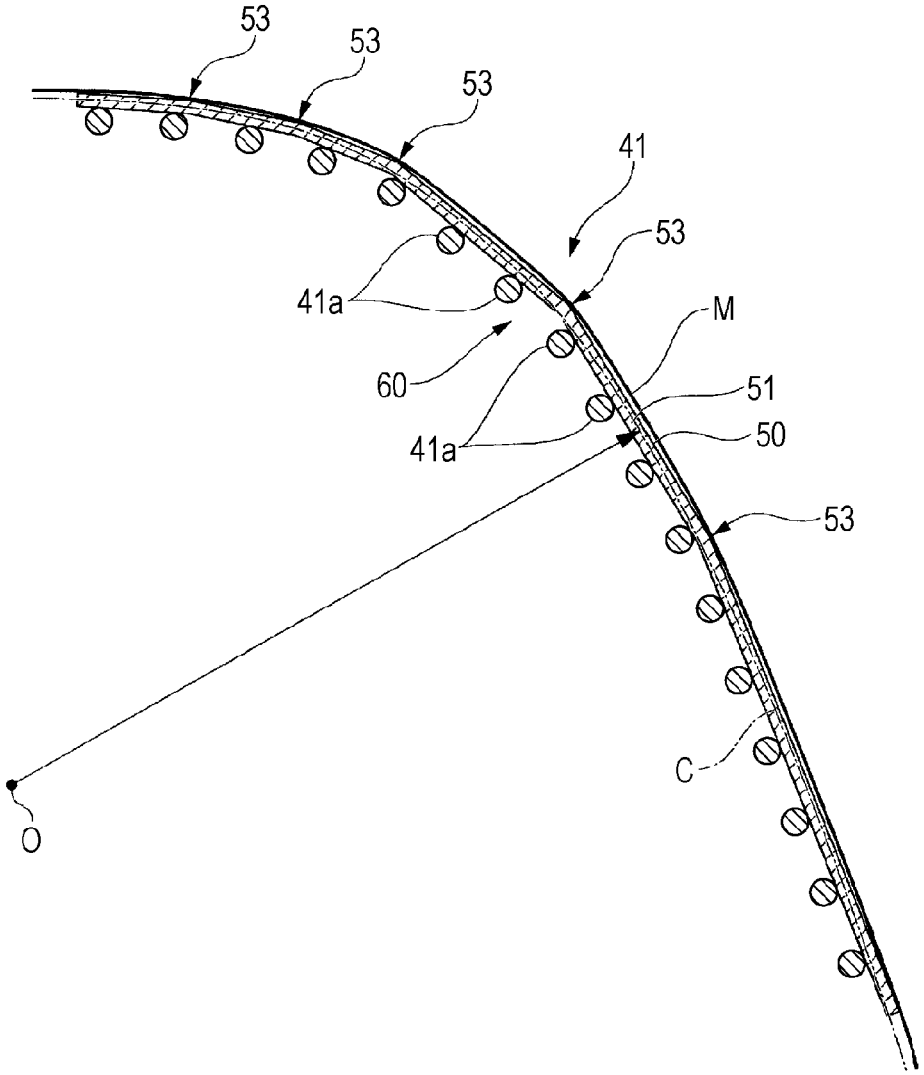
FIG. 4 is a cross-sectional view showing the configuration of a preheater unit according to a second embodiment of the invention.
Figure 5:
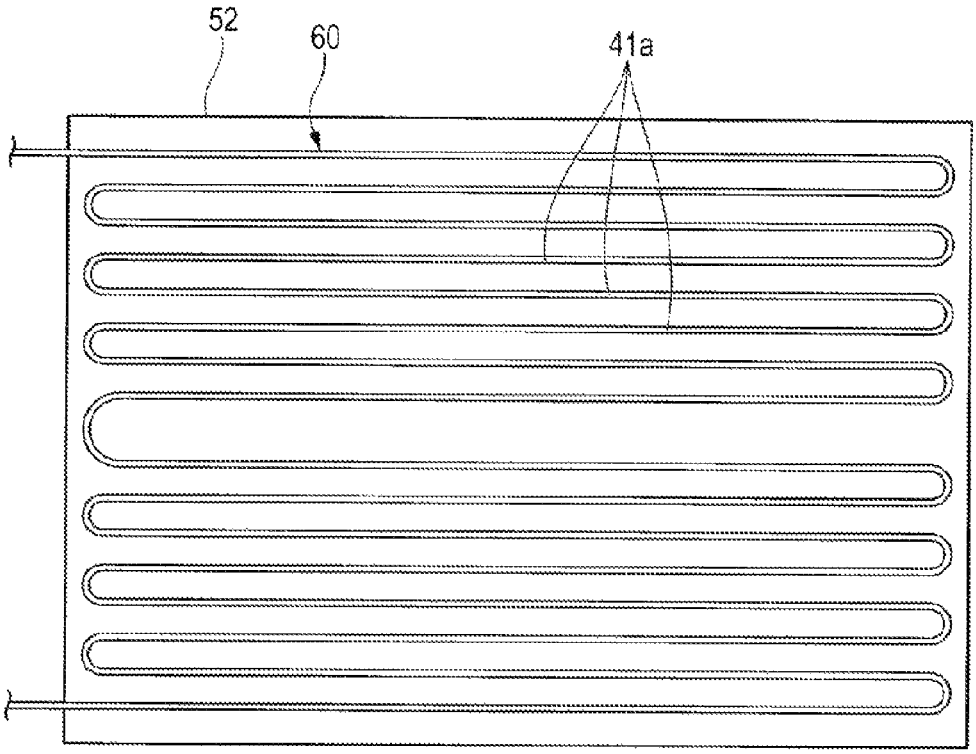
FIG. 5 is a plan view showing the configuration of heaters according to the second embodiment of the invention.

FIG. 4 is a cross-sectional view showing the configuration of the preheater unit 41 according to the second embodiment of the invention. FIG. 5 is a plan view showing the configuration of the heater 41*a* according to the second embodiment of the invention.

A heating section 60 according to the second embodiment includes a supporting member 51 and heaters 41*a* (indirect-heating devices).

The heaters 41*a* according to the second embodiment heat the medium M supported on the supporting surface 50 from the back by transferring heat through the supporting member 51. The heaters 41*a* are disposed with gaps in the transporting direction (the up-down direction of the paper in FIG. 5). In detail, the heaters 41*a* are arranged at regular gaps in the transporting direction. Therefore, the temperature of the supporting surface 50 is substantially uniform from the furthest upstream portion to the furthest downstream portion in the transporting direction.

As shown in FIG. 4, the supporting member 51 has a plurality of bends (bending portions 53) with gaps in the transporting direction of the medium M and is convex on the support surface 50 side and, as a whole, is substantially curved. In other words, the supporting member 51 shaped to bend in the transporting direction along a virtual curve C (see FIG. 5) with the center O of curvature (see FIG. 5) at the opposite side to where the supporting surface 50 is disposed.

The bending portions 53 are disposed with the gaps decreasing to the downstream in the transporting direction. In detail, the gap between the bending portions 53 close to the downstream side in the transporting direction is smaller than the gap between the bending portions 53 close to the upstream side in the transporting direction.

According to the configuration described above, since the gaps between the bending portions 53 decrease toward the downstream side in the transporting direction, the area, which comes in contact with the bending portions 53 (supporting surface 50) heated by the heaters 41*a* as the medium M is moved to the downstream side in the transporting direction, increases, and as result, it is possible to increase the amount of heat per unit time which is applied to the medium M, toward the downstream side in the transporting direction.

That is, the medium M substantially comes in contact only with the peaks of the bending portions 53 in the bending transporting path, such that it is possible in the second embodiment to increase the thermal contact area and the amount of heat per unit time which is applied to the medium M toward the downstream in the transporting direction, without changing the arrangement of the heaters 41*a*, as in the first embodiment, by decreasing the gaps between the bending portions 53 toward the downstream side in the transporting direction. Further, since the heating section 60 is implemented by densely arranging the bending portions 53, it is unnecessary to separately provide a device for controlling temperature and it is possible to contribute to reducing cost, even in the second embodiment.

Although preferred embodiments of the invention were described above with reference to the drawings, the invention is not limited to the embodiment. The shapes or the combination of the components shown in the embodiment are an example and they may be changed in various ways on the basis of the desired design without departing from the spirit of the invention.

For example, in the heating section 60, the heating sources may be arranged at predetermined distances from the supporting surface 50 along the supporting surface 50 such that the distance between the heating sources and the supporting surface 50 decreases toward the downstream side in the transporting direction. According this configuration, since the heating sources are arranged close to the supporting surface 50 along the supporting surface 50 toward the downstream side in the transporting direction, it is possible to increase the amount of heat per unit time that is applied to the medium M toward the downstream in the transporting direction.

Further, for example, in the configuration of the heating sources of the preheater unit 41, a gas or liquid may be used as a thermal medium, electric heating, such as resistance heating or induction heating, may be used, or combinations of them may be used.

Further, for example, it is exemplified that the heating section 60 according to the embodiment is implemented by densely arranging the heaters 41*a* or the bending portions 53, but the configuration is not limited thereto.

For example, the heating section 60 may be provided with a temperature control unit that increases the temperature of the heating sources arranged along the supporting surface 50, toward the downstream side in the transporting direction. According this configuration, since the temperature of the heating sources arranged along the supporting surface 50 increases toward the downstream side in the transporting direction, it is possible to increase the amount of heat per unit time that is applied to the medium M toward the downstream in the transporting direction. In this case, for example, heating wires may be used as the heating sources while a power unit controlling the voltage applied to the heating wires may be used as the temperature control unit.

In the embodiment, although it is exemplified when the recording apparatus is the printer 1, the recording apparatus is not limited to printers and may be a copy machine or a facsimile or the like.

Further, a recording apparatus that ejects or discharges another fluid, other than ink, may be employed as the recording apparatus. The invention may be used for various recording apparatuses including a recording head that discharges a small amount of droplets, for example. Further, droplets mean the state of fluid discharged from the recording apparatus, including a particle shape, a tear shape, and ones with a string-shaped tail. Further, the fluid should be a material that the recording apparatus can eject. For example, the material should be in a liquid state, like a fluid state such as: fluid with high or low viscosity, sol, gel water, other inorganic solvents, organic solvents, solution, liquid-state resin, liquid-state metal (metallic melt), including not only liquid as one state of the material, but a substance where particles of a functional material made of solid materials, such as a colorant or metal particles are dissolved, dispersed, or mixed in a solvent. Further, the ink described in the embodiment may be a typical example of the fluid. The ink includes various fluid compounds, such as common aqueous ink, oil-based ink, gel ink, and hot-melt ink. Further, the recording medium includes paper sheet, functional paper, substrate, and metal plate, other than plastic films, such as a vinyl chloride series-based film.

What is claimed is:

1. A recording apparatus comprising:

a recording head that ejects liquid onto a recording medium;

a transporting device that includes:

a first supporting member that includes a first supporting surface, the first supporting member disposed on an upstream side of the recording head in a transporting direction, the first supporting surface forming a curve; and a second supporting member that includes a second supporting surface, the second supporting member disposed on a downstream side of the recording head in the transporting direction, the second supporting surface collectively forming a curve, a tensioning device disposed downstream the second supporting member and upstream of a roll that winds the recording medium, wherein the transporting device transports the recording medium along the first supporting surface and the second supporting surface, and wherein the recording apparatus is configured to support the roll that winds the recording medium that is under the second supporting member.

2. The recording apparatus according to claim 1, wherein the first supporting member includes a plurality of bending portions and portions of the supporting member disposed between the plurality of bending portions collectively form a curve.

3. The recording apparatus according to claim 1, wherein the second supporting member includes a plurality of bending portions and portions of the supporting member disposed between the plurality of bending portions collectively form a curve.

* * * * *